US007225878B2

(12) United States Patent
Holcomb et al.

(10) Patent No.: US 7,225,878 B2
(45) Date of Patent: Jun. 5, 2007

(54) METHODS AND APPARATUS FOR PRODUCTION OF HYDROCARBONS

(76) Inventors: James R. Holcomb, 2156 Barksdale Blvd., Bossier City, LA (US) 71112; John L. Leenerts, 2156 Barksdale Blvd., Bossier City, LA (US) 71112

( * ) Notice: Subject to any disclaimer, the term of this patent is extended or adjusted under 35 U.S.C. 154(b) by 0 days.

(21) Appl. No.: 10/305,524

(22) Filed: Nov. 26, 2002

(65) Prior Publication Data

US 2004/0099417 A1 May 27, 2004

(51) Int. Cl.
*E21B 34/02* (2006.01)
*E21B 37/10* (2006.01)
*E21B 43/25* (2006.01)

(52) U.S. Cl. ..... 166/369; 166/53; 166/68; 166/105; 294/86.22; 417/555.2

(58) Field of Classification Search ..... 166/311, 166/68, 68.5, 72, 105, 369, 176, 53; 417/555.2; 294/68.22

See application file for complete search history.

(56) References Cited

U.S. PATENT DOCUMENTS

| | | | | |
|---|---|---|---|---|
| 1,883,053 | A | 10/1932 | Standlee | |
| 2,272,963 | A | 2/1942 | Budd | |
| 2,482,455 | A | 9/1949 | Bailey | |
| 3,072,193 | A | 1/1963 | Ziegler et al. | |
| 3,489,066 | A | 1/1970 | Wilson | |
| 4,037,662 | A | 7/1977 | Bowling | 166/311 |
| 4,086,035 | A * | 4/1978 | Klaeger et al. | 417/410.1 |
| 4,319,518 | A | 3/1982 | Vicens | |
| 4,368,909 | A | 1/1983 | Alexander, Jr. | 294/69 R |
| 4,583,916 | A * | 4/1986 | Senghaas et al. | 417/36 |
| 4,751,969 | A * | 6/1988 | Klaeger | 166/369 |
| 4,889,473 | A | 12/1989 | Krueger | |
| 5,097,901 | A * | 3/1992 | Klaeger | 166/68 |
| 5,462,115 | A | 10/1995 | Belden et al. | |
| 5,692,567 | A * | 12/1997 | Doner | 166/369 |
| 5,921,320 | A | 7/1999 | Shulyatikov et al. | |
| 6,460,622 | B1 * | 10/2002 | Rice | 166/369 |
| 6,497,281 | B2 * | 12/2002 | Vann | 166/250.15 |

OTHER PUBLICATIONS

Database WPI, Section Ch, Week 200067, Derwent Publications Ltd., London, GB; AN 2000-685338, XP 002277676 & RU 2 151 916 C (Ranko NPAK Stock Co), Jun. 27, 2000.

* cited by examiner

*Primary Examiner*—Kenneth Thompson
(74) *Attorney, Agent, or Firm*—Mark R. Wisner

(57) ABSTRACT

Apparatus and methods for producing fluids from a well and for controlling the production of fluids from multiple wells, particularly from a remote location. The well is provided with a winch/cable drum having a cable wound thereon with a swabbing tool on the end of the cable. The swabbing tool is initially located in a riser that is mounted to the wellhead and lowered into the well and down through the fluids in the well under control of a programmable logic controller (PLC 95). Upon reaching a pre-determined depth, the PLC 95 stops the rotation of the winch/cable drum and then reverses the direction of rotation to retrieve the swabbing tool, thereby lifting the fluids in the well bore up out of the well. Flowline connections, with appropriate valves, are provided in the riser for routing any gas and oil that is lifted from the well into pipelines and on to storage tanks or separators as the swabbing tool is retrieved. The PLC 95 is programmed for manual operation, for independent control of the well-head apparatus, and/or for operation from a remote location.

17 Claims, 4 Drawing Sheets

FIG.3
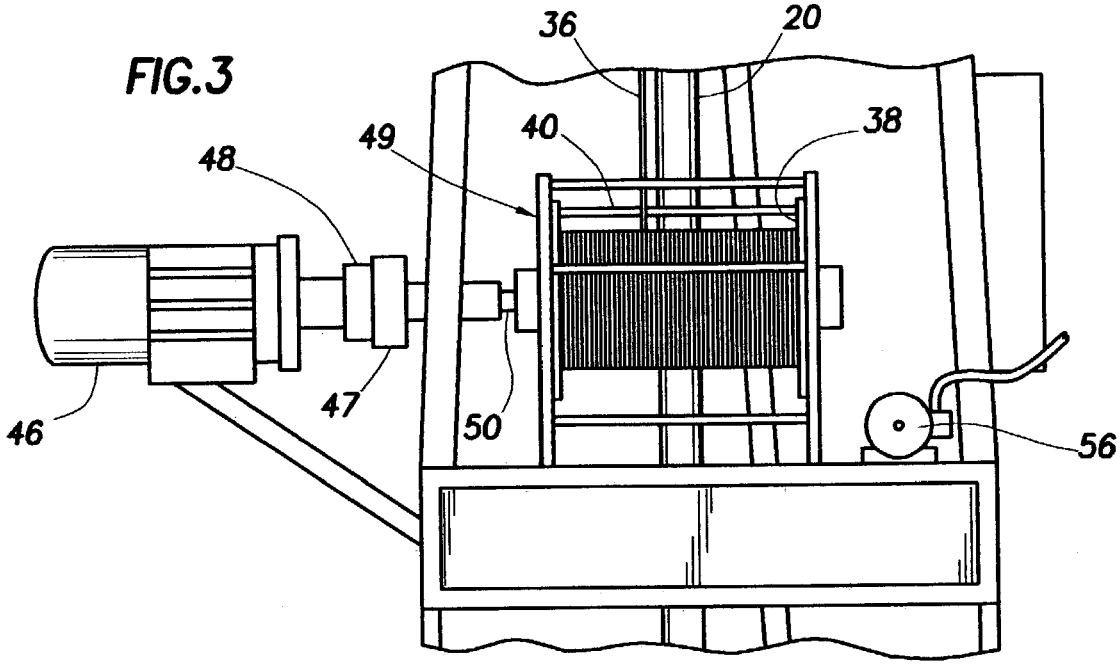
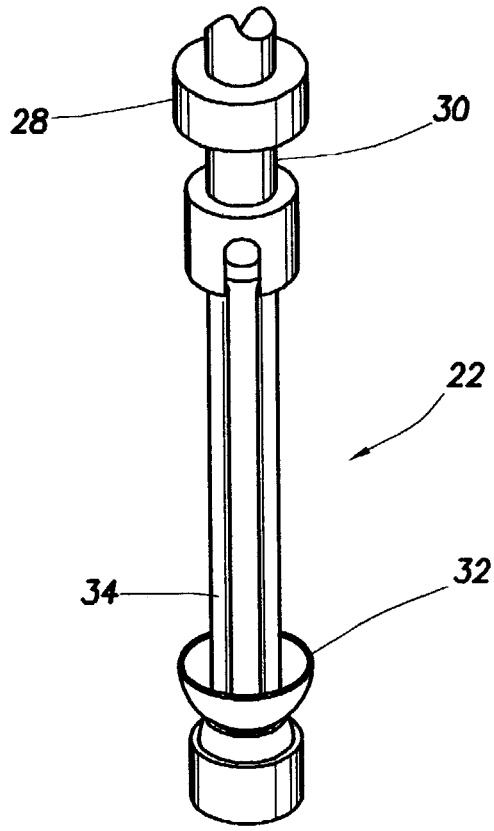
FIG.4

METHODS AND APPARATUS FOR PRODUCTION OF HYDROCARBONS

BACKGROUND OF THE INVENTION

The present invention relates to methods and apparatus for production of hydrocarbons. More specifically, the present invention relates to methods and apparatus for mounting to the well head of an oil and/or gas well, particularly a tight or low pressure well with limited production, for use in producing hydrocarbons from the well.

It is common practice in the oilfield to pump hydrocarbons from oil and gas wells, but there are many wells that do not produce hydrocarbons at a rate sufficient to justify the capital cost of pumping equipment and/or the energy and maintenance costs of operating the pumping equipment. Even though such wells may be steady producers, they produce at such low volumes that the operator simply cannot afford to produce from the well, effectively requiring that the pump be removed from such wells and that the wells be capped.

The most prevalent form of artificial lift system for relatively shallow and low-volume wells is sucker-rod pumps. Rod pumping uses arm-like devices to provide up-and-down motion to a downhole pump. However, expensive workover rigs and personnel are needed to replace the downhole pumps and pull the sucker rods. The present invention has eliminated the sucker-rod pumps themselves and the need for expensive workover rigs.

One alternative to wellhead pumping equipment, at least for gas fields, is a plunger lift system. A plunger lift system relies on bottom hole pressure. A plunger is inserted downhole and the well is shut-in to allow pressure to build. However, such systems have proven ineffective in many areas due to lack of gas pressure. The present invention does not require bottom hole pressure to operate and does not require a shut-in time to wait for the pressure to build.

U.S. Pat. No. 5,097,901 addresses these problems to some extent by providing a so-called mobile pumping apparatus that is mounted on a truck or tractor chassis and that actually lifts oil from the well with swab cups on a swab bar that is mounted on the end of a cable. After the wellhead equipment is removed from the well, the truck or tractor drives to the wellhead. The swab bar is lowered down into the well and then retrieved, pulling the liquids in the well up with the swab and into a storage tank mounted on the truck or tractor.

Although the mobile pumping apparatus of the type disclosed in U.S. Pat. No. 5,097,901 works well for many wells, particularly wells that are closely spaced in a single field, it does have certain disadvantages and limitations. For instance, they are not useful for producing gas from a well. Also, the wells serviced by such mobile pumping apparatus are open to the atmosphere, allowing the casing to oxidize. Further, although they are effective for producing oil accumulated in a well bore, the most important limitation of mobile pumpers may be that they are not capable of increasing production from a well with low bottom hole pressure above historical yield (and the bottom hole pressure is low in most fields in which mobile pumpers are used). Consequently, their use in a field with low bottom hole pressure does not optimize production from the field.

Another problem with production of hydrocarbons from many fields (not just fields with low bottom hole pressure) is the environmental impact of producing the hydrocarbons. There are many such environmental problems that must be overcome and/or minimized, but describing one such problem will illustrate the advantages of the present invention.

Specifically, the production from wells that are being pumped eventually decreases as a result of the accumulation of particulates, paraffin, and/or other materials in the well and/or well bore. To increase production from such wells requires pulling the sucker rods from the well so that the well bore can be swabbed, acidized, perforated, and/or any of several other operations. Of course the sucker rods are immersed in oil, and when they are pulled from the well, the oil must be contained rather than allowed to drip on the ground around the well. Because the present invention does not use sucker rods, this source of environmental contamination is eliminated from the hydrocarbon production process, and it is therefore an object of the present invention to decrease the environmental impact of producing hydrocarbons from wells.

It is also an object of the present invention to address some of these other limitations and disadvantages of prior art methods and apparatus for producing hydrocarbons from wells, particularly in wells that produce relatively small quantities of hydrocarbons and/or produce hydrocarbons irregularly. More particularly, it is an object of the present invention to provide methods and apparatus for producing hydrocarbons from wells that provide the capability of producing gas as well as oil, that maximize production from the well, and that require minimal operator intervention.

It is also an object of the present invention to provide a method and apparatus for producing both gas and oil from a well.

It is also an object of the present invention to provide a method and apparatus for producing hydrocarbons from a well in a field with low bottom hole pressure.

Another object of the present invention is to provide a sealed system for producing hydrocarbons from a well that reduces oxidation of the casing of the well and stimulates production from the well.

It is also an object of the present invention to provide a method and apparatus for controlling the production of hydrocarbons from several wells in a field.

It is also an object of the present invention to provide a method and apparatus for controlling the production of hydrocarbons from one or more wells from a remote location.

Yet another object of the present invention is to provide a method and apparatus that decreases the cost of producing the hydrocarbons from one or more wells.

Conventional swabbing units and the above-described mobile pumping apparatus place considerable strain on the swab cups during the retrieval of the swab from downhole, and it is therefore also an object to increase the life of the swab cups utilized to produce hydrocarbons from a well bore in accordance with the method and apparatus of the present invention.

Other objects and advantages of the present invention will be made clear to those skilled in the art by the following description of the presently preferred embodiments thereof.

SUMMARY OF THE INVENTION

These objects are achieved by providing an automated apparatus for producing fluids from a well comprising a riser attachable to the wellhead of a well and a winch/cable drum having a cable wound thereon for winding and unwinding from said winch/cable drum. The cable passes down through the riser and has a swabbing tool attached to the end thereof. The riser is provided with first and second flowline connections, each flowline connection having a valve therein. Controls are provided for (a) opening the valve in the first flowline connection upon rotation of the winch/cable drum to wind the cable onto the winch/cable drum to retrieve the swabbing tool from the well and then (b) closing a valve under the swabbing tool and opening a valve in the second flowline connection when the swabbing tool reaches a predetermined point during retrieval from the wellbore.

In a second aspect, the present invention provides a method for producing hydrocarbons from a well comprising the steps of lowering a swabbing tool into the fluids in a wellbore to a selected depth and then retrieving the swabbing tool from the wellbore to raise the fluids therein up out of the wellbore. A valve in a first flowline connection in fluid communication with the wellbore is opened while the swabbing tool is being retrieved and then, when the swabbing tool reaches a predetermined height, a valve is closed under the swabbing tool. A valve in a second flowline in fluid communication with the wellbore is opened either while the valve under the swabbing tool is being closed or after the valve is closed under the swabbing tool.

BRIEF DESCRIPTION OF THE DRAWINGS

FIG. 3 is an enlarged view of the apparatus of FIG. 2.

FIG. 4 is a perspective view of the swab bar and cups utilized in connection with the apparatus of FIG. 2.

DETAILED DESCRIPTION OF THE PREFERRED EMBODIMENT

Figure 1:
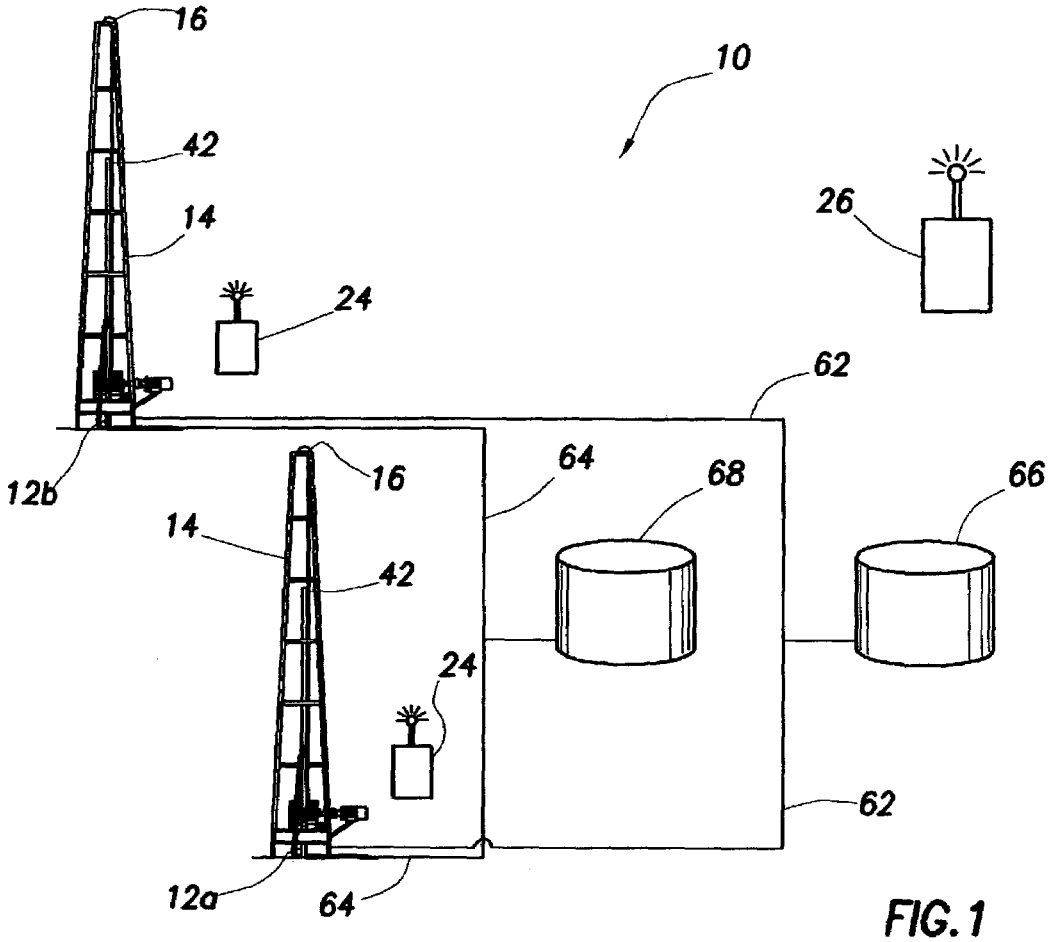
FIG. 1 is a schematic view of a preferred embodiment of an apparatus for producing hydrocarbons from several wells in a field constructed in accordance with the teachings of the present invention.

Referring to FIGS. 1–5, a preferred embodiment of an apparatus constructed in accordance with the teachings of the present invention is shown installed in a field 10 that includes several hydrocarbon producing wells 12*a*, 12*b*, etc. Each well 12*a*, 12*b*, etc. is provided with derrick 14 attached to a table or pan, 18 (FIG. 2) that provides a base for a sheave 16. A riser pipe 20 is attached to the wellhead, which is mounted to the casing (FIG. 3), and houses the swabbing tool 22 (see FIG. 4) and sensors as described below. Another object of the derrick 14 is to provide an appropriate fleet angle for the cable 36 to wrap properly and to eliminate the need for an expensive level wind or other tool. Each of the wells 12*a*, 12*b*, etc. is also provided with a control panel 24 (best shown in FIG. 2) that, as set out below, includes a programmable logic controller (PLC) 95 and radio transceiver 92 for interacting with a master control panel 26 (FIG. 1), also including a PLC 96 (not shown) and radio transceiver 93 (not shown), for controlling and/or monitoring the equipment installed on each of the wells 12*a*, 12*b*, etc. in field 10 in the manner described below. Although those skilled in the art will recognize that it is not required, to assist in erecting and quickly laying down the derrick 14, two of the legs of the derrick are provided with hinges 13 (not shown) and the two opposite legs are provided with holes (not numbered) for receiving pins 15 (not shown) for locking the derrick in the upright position.

Swabbing tool 22 (shown in FIG. 4) is comprised of a rope socket (not shown), weight bar 30, swab cup 32, and mandrel 34, all of a type known in the art, with a nonferrous ring 28 mounted around the bottom of the weight bar 30 just above mandrel 34 for a purpose set out below. The swabbing tool 22 is installed on the end of the cable 36 that is wound on a winch/cable drum 38 (FIG. 3) mounted to table 18. Cable 36 is wound off the winch/cable drum 38 past a floating tension bar 40, up to the sheave 16, and then down into the top of riser pipe 20. As cable 36 enters the top of riser pipe 20, it passes through a pneumatic, electric, or hydraulically-activated oil saver 42 mounted to the top of riser 20. Oil saver 42 clamps the cable 36 when pressurized to wipe oil from cable 36, preventing oil and/or gas from exiting from the top of riser 20, and isolates the well from the environment during production of fluids therefrom as described below. Swabbing tool 22 is mounted to cable 36 below oil saver 42 and passes down through riser 20 and into the well casing. A hammer union 44 is mounted in riser 20 for ease in servicing the swabbing tool 22 mounted on the end of cable 36. Replacement of the swab cup 32 and replacement of the rubber in the oil saver 42 are the only maintenance needs (workover) for this invention.

An electric motor 46 is provided for powering the winch/cable drum 38 through a gearbox 47 provided for mechanical advantage as known in the art, and in the preferred embodiment, a variable frequency drive (VFD) 97 is provided for changing the speed of motor 46. In the preferred embodiment, the gearbox 47 is also provided with an electric brake 48 that is "off" as long as electricity is provided to the motor but which is switched "on" in the event of a power interruption for a purpose to be described below. An alternative to the gear box 47 and electric brake 48 is having a chain and sprocket on either side of the winch drum cable. A second alternative to the electric motor 46 with a VFD 97 is electric motor 46 powering a hydraulic pump (not shown) for pumping hydraulic fluid to a hydraulic motor for operating winch/cable drum 38. The same gearbox 47 and electric brake 48 or chain and sprocket can be used in either configuration. An electric motor/hydraulic pump 56 is provided for use to pressurize oil saver 42.

Figure 5:
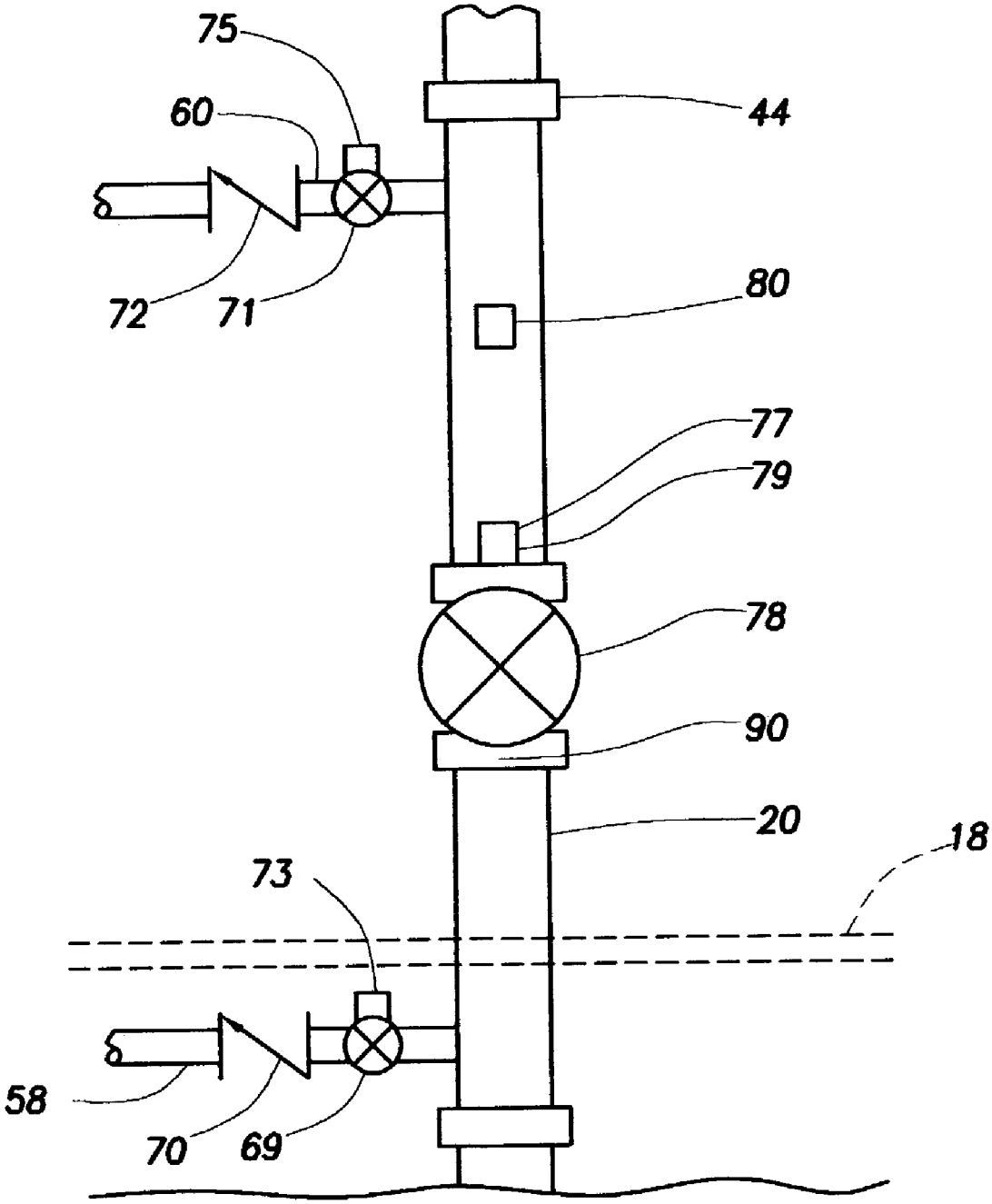
FIG. 5 is an enlarged, partially schematic view of the table and riser pipe of the apparatus of FIG. 2 mounted to a wellhead and with many of the other components of the apparatus removed so as to show certain detail.

Referring now to FIG. 5, riser 20 is provided with two flowline connections, the first, larger diameter connection 60 for fluid and gas flow and the second connection 58 for fluid and gas flow. Appropriate pipelines 62, 64 (see FIG. 1) are connected to the respective flowline connections 58, 60 for conveying gas and fluid to collection tanks and/or separators 66 and 68, respectively. Each of the flowline connections 58, 60 is provided with a one-way check valve 70 and 72, respectively, and a valve 69 and 71, respectively, under control of appropriate actuators and 73, 75, respectively. Valves 69 and 71 control flow through the flowline connections 58, 60, and check valves 70, 72 prevent flow back into riser 20. A valve 78 with actuator 79 and non-ferrous proximity switch/sensor 80 is also mounted in riser 20 for a purpose set out below.

Operation of one cycle of the apparatus mounted to each of the wells 12*a*, 12*b*, etc. is as follows. When the swabbing tool 22 is above the valve 78 as sensed by interaction between the above-described non-ferrous ring 28 mounted on swabbing tool 22 and non-ferrous proximity sensor/switch 80, the valve 78 is opened by actuator 79, the hydraulic pressure to oil saver 42 is released, and valve 69 is closed and valve 71 is opened by their respective actuators 73, 75. After the electric motor 46 is energized, the motor 46 unwinds cable 36 from the winch/cable drum 38 to lower the swabbing tool 22 down through the valve 78 and into the well to a predetermined depth. A proximity switch/sensor 50 near the shaft of the winch/cable drum 38 sends signals enabling the PLC 95 to count rotations of the drum of winch/cable drum 38 to determine depth and therefore stop the motor 46 when swabbing tool 22 reaches the predetermined depth. Alternatively, a proximity switch/sensor (not shown) near the sheave 16 outputs signals enabling the PLC 95 to approximate the length of cable 36 that passes over the sheave 16 for determining the depth to which swabbing tool 22 is lowered. The cable 36 winds off of the drum under tension bar 40, and tension bar 40 is provided with a sensor 49 so that, if cable 36 goes slack (for instance, because swabbing tool 22 is not dropping down through the fluid in the well quickly enough and/or gets stuck in the well), motor 46 stops. Alternatively, the proximity switch/sensor near the sheave 16 can be used to determine that cable 36 has stopped winding off the drum and to stop motor 46. The swab cup 32 floats on mandrel 34 as swabbing tool 22 is lowered down into the well so that fluids can pass between the swab cup 32 and the body of mandrel 34 through one or more longitudinal grooves (not numbered) on mandrel 34 in a manner known in the art.

After the swabbing tool 22 reaches the predetermined depth, motor 46 is reversed to pull the swabbing tool 22 up out of the well. When swabbing tool 22 starts upwardly, swab cup 32 seals against the seat formed by that enlarged portion (not numbered) of mandrel 34 and, as the swabbing tool 22 continues upwardly, the swab cup 32 pulls the fluids in the well upwardly with it. At a predetermined level, the oil saver 42 is pressurized. As the swabbing tool 22 is retrieved, valve 69 remains closed, the fluid and gas is routed out of riser 20 into flowline connection 60 and on to pipeline 64 and storage tank and/or separator 68 as swabbing tool 22 rises. When the swabbing tool 22 rises above the valve 78 as sensed by interaction between the above-described non-ferrous ring 28 mounted on swabbing tool 22 and non-ferrous proximity sensor/switch 80, the motor 46 and winch/cable drum 38 is stopped, valve 71 is closed, and valve 69 is opened so that gas and fluid that rises up the wellbore from under the oil flows out of flowline connection 58 and is routed out of riser 20 into pipeline 62 and on to storage tank and/or separator 66. Finally, valve 78 under swabbing tool 22 is closed and oil saver 42 remains pressurized. Alternatively, the oil saver 42 pressure can be released once valve 78 is closed. Releasing pressure on the oil saver 42 and/or closing valve 78 reduces pressure on the swab cup 32, preventing swelling of the cup and increasing its useful life.

Those skilled in the art who have the benefit of this disclosure will also recognize that the swab cup 32 of swabbing tool 22 seals against the inside diameter of the casing or tubing in the well 12*a,* 12*b,* etc. as swabbing tool 22 is being retrieved from the well. In addition to cleaning the casing of obstructions such as paraffin, because it is a closed system, this sealing of swab cup 32 against the casing creates a vacuum under the swabbing tool 22, pulling additional hydrocarbons out of the formation and into the well bore, thereby increasing production from the well. The present invention is designed for both tubing swabbing and casing swabbing. On gas wells, where we are just removing fluid, we have the option to use tubing. A direct benefit of using tubing is that a packer can be utilized without the worry about gas-locking that occurs with a sucker-rod pump.

As noted above, in the preferred embodiment, a VFD 97 is provided for changing the speed of motor 46, and the speed changes are utilized as follows. The initial speed of the motor is set to lower the swabbing tool 22 to above fluid level. Before the swabbing tool enters the fluid, the initial speed of the motor 46 is decreased to a first selected rate that allows the swabbing tool 22 to sink down through the fluids in the well. When the motor 46 is reversed to pull the swabbing tool 22 back up out of the well, the speed of motor 46 is returned to the faster, initial speed to ensure that the swab cup 32 creates the above-described seal against the inside diameter of the casing or tubing in the well 12*a,* 12*b,* etc. as swabbing tool 22 is being retrieved from the well. At a first point in the retrieval of the swabbing tool 22 and according to the volume of oil retrieved by the swabbing tool 22, the speed of motor 46 is again decreased to the first selected rate so as to accommodate the step down in the diameter of the well bore and riser 20 to the flowline connection 60. At a second selected point in the retrieval, the speed of motor 46 is decreased even more to a second selected rate so as to reduce pressure on the oil saver 42 and swab cup 32 and to allow the interaction between the above-described non-ferrous ring 28 mounted on swabbing tool 22 and non-ferrous proximity sensor/switch 80. The interaction between the non-ferrous ring 28 and the non-ferrous proximity sensor/switch 80 ensures that the swabbing tool 22 is stopped at a selected location during retrieval in each cycle. The location of the non-ferrous ring 28 is to ensure that the swab cup 32 has not gone above the flowline 60 and that the swab cup 32 has traveled above valve 78 so that valve 78 can close. It will also be recognized that the electric motor 46 can be utilized to drive a hydraulic pump so that the winch/cable drum 38 can be driven with a hydraulic motor, in which case the speed of the swabbing tool 22 in the well is controlled by, for instance, a spool valve and actuator as known in the art.

There are five levels of control for the wellhead apparatus in the preferred embodiment. The first level, accomplished from control panel 24, is the manual operation of the wellhead apparatus. The second level is also accomplished from control panel 24 under the control of the above-described PLC 95. A third level of operation involves the interaction between the master control panel 26 and a plurality of control panels 24 operating the respective wellhead apparatus at the direction of a PLC 96 (not shown) located in master control panel 26. It will also be recognized that a fourth level of control is possible, specifically, control of the master control panel 26 from a remote location and the use of master control panel 26 to relay control signals to each of the control panels 24 for operation of the wellhead apparatus. And finally, control of an individual control panel 24 from a remote location is available when wells are widely dispersed.

All levels of control utilize the PLC 95 and VFD 97 in control panel 24 and require minimal operator intervention. Control panel 24 houses the PLC 95, VFD 97, VFD keypad and display 98, radio transceiver 92, horn 107, surge protector, battery, uninterruptible power supply, and appropriate transformers and rectifiers. The face of the control panel 24 has appropriate push buttons, selector switches, and indicator lights for manual operation, calibration, and troubleshooting. Alternatively, an alphanumeric display can be used on the face of control panel 24. Terminal strips in control panel 24 interface PLC 95 inputs and outputs to devices and sensors mounted at the well.

Figure 2:
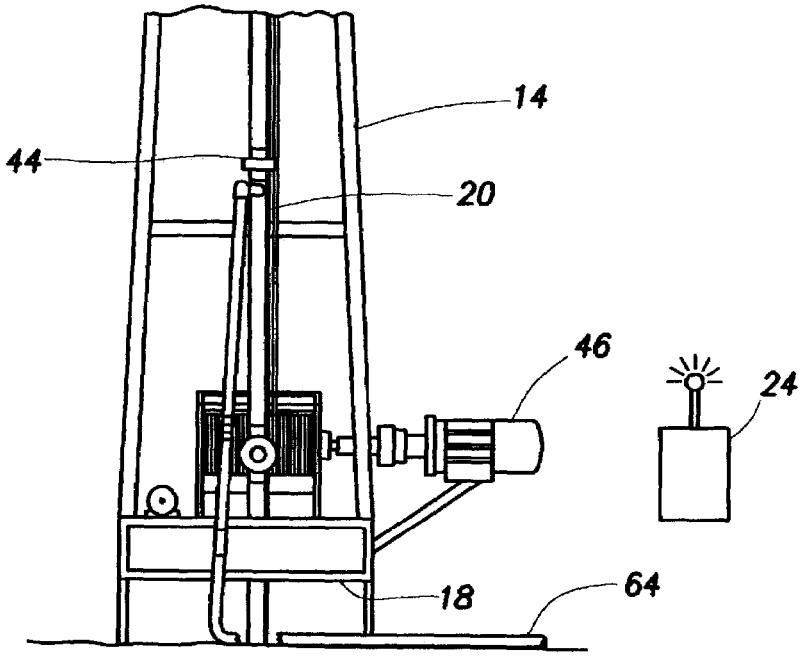
FIG. 2 is a perspective view of the apparatus of FIG. 1 showing the equipment installed on an individual wellhead.
Figure 6:
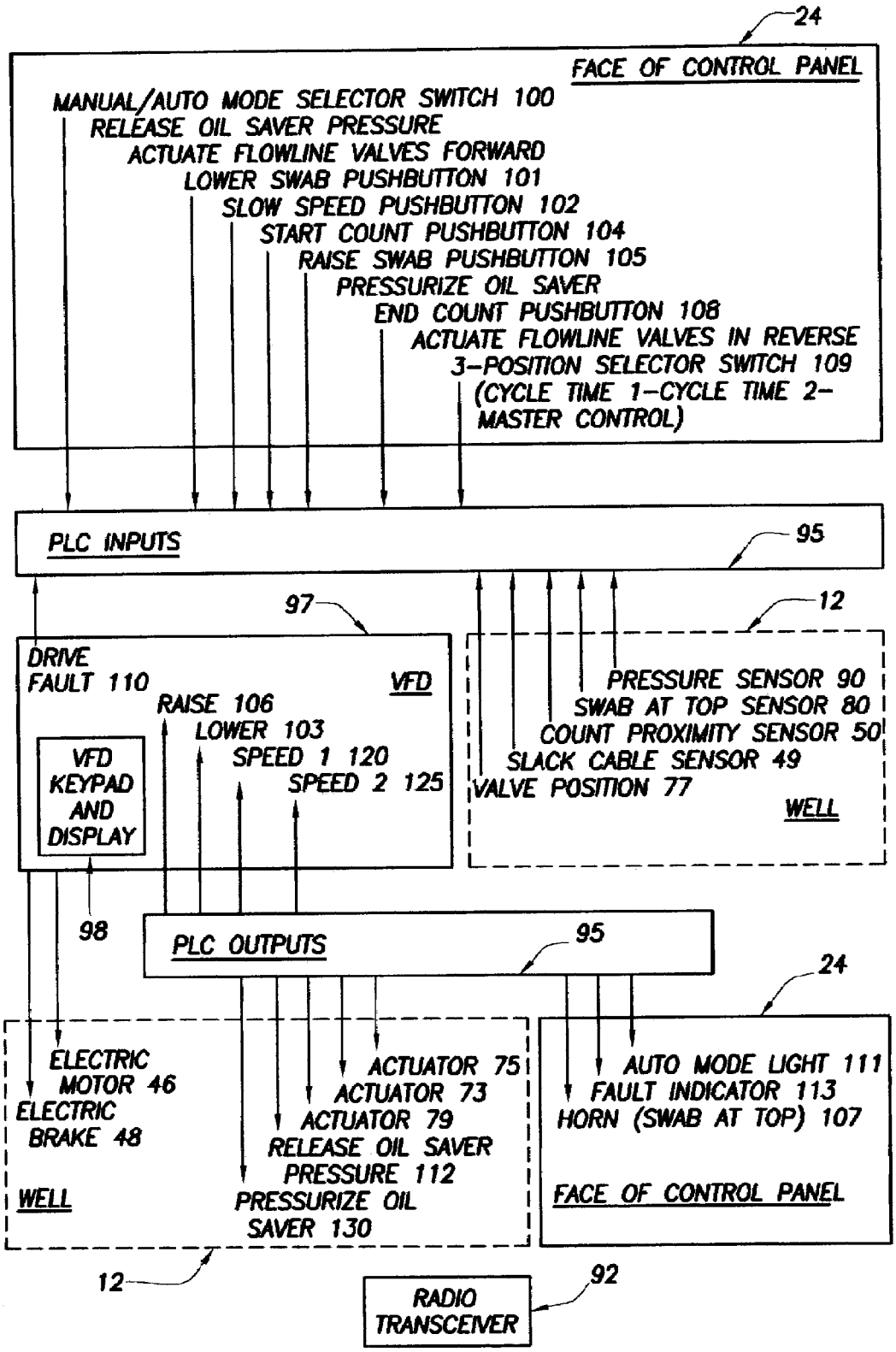
FIG. 6 is a block diagram of a presently preferred embodiment of the electrical components of the apparatus of FIG. 2.

A block diagram of the presently preferred embodiment of the electrical components of the apparatus of FIG. 2 constructed in accordance with the teachings of the present invention is shown in FIG. 6.

The first level of operation is the manual mode. The manual mode is used to troubleshoot, calibrate, and operate the apparatus. The operator selects the manual mode at a manual/auto selector switch 100 on the face of control panel 24. The status of this manual/auto selector switch 100 is monitored by the PLC 95. To begin a cycle, the operator manually opens valve 78. Alternatively, the operator could operate valve 78 by a pushbutton (not shown) on control panel 24. Pushbuttons on the control panel allow the operator to bypass the PLC 95 outputs and operate hard-wired relays that release the hydraulic pressure to oil saver 42, close valve 69, and open valve 71. To operate the electric motor 46 in the preferred embodiment, the operator must press and hold the lower swab pushbutton 101 as an input to the PLC 95. The PLC 95 outputs a contact 103 that is wired to the low-voltage control inputs of the VFD 97. The VFD 97 energizes the 480 VAC electric motor 46 and electric motor 46 unwinds cable 36 from the winch/cable drum 38 to lower the swabbing tool 22. To adjust the speed of the VFD 97, the operator must also press and hold the slow speed pushbutton 102 as an input to the PLC 95. The PLC 95 adjusts the speed of the VFD 97 via outputs that are wired to the low-voltage speed control inputs of VFD 97. The VFD provides an interface between the PLC 95 and the electric motor 46 in the preferred embodiment.

The operator releases the lower swab pushbutton 101 and the low speed pushbutton 102 when the operator determines that the swabbing tool 22 has reached the desired depth for a cycle. The operator can calibrate that depth by pressing the start count pushbutton 104. The start count pushbutton 104 in the manual mode initiates an internal counter 1 in the PLC 95 that senses a proximity switch/sensor 50 near the shaft of the winch/cable drum 38 and counts rotations of the drum of winch/cable drum 38. Alternatively, a proximity switch/sensor near the sheave 16 outputs signals enabling the PLC 95 to approximate the length of cable 36 that passes over the sheave 16 for determining the depth to which swabbing tool 22 is lowered.

To retrieve the swabbing tool 22 in the manual mode, the operator must press and hold the raise swab pushbutton 105 as an input to the PLC 95. The PLC 95 outputs a contact 106 that is wired to the VFD 97. The VFD 97 reverses motor 46 to pull the swabbing tool 22 up out of the well. To adjust the speed of the VFD 97, the operator must again press and hold the slow speed pushbutton 102 as an input to the PLC 95.

Before the swabbing tool is retrieved, the operator depresses a pushbutton on the control panel 24 that bypasses the PLC 95 outputs and pressurizes oil saver 42.

A horn 107 is activated by the PLC 95 when the swabbing tool 22 rises above the valve 78 as sensed by interaction between the above-described non-ferrous ring 28 mounted on swabbing tool 22 and non-ferrous proximity sensor/switch 80. Upon hearing this horn, the operator releases raise swab pushbutton 105 and slow speed pushbutton 102, and the motor 46 and winch/cable drum 38 is stopped.

To complete the calibration of the desired depth for a cycle, the operator depresses the end count pushbutton 108. The accumulated count from counter 1 internal to the PLC 95 is saved in a calibration memory location for use in the automatic modes of operation.

The operator can choose at this point to switch to the auto mode 100 for the beginning of a new cycle or the operator can complete the current cycle in the manual mode. To complete the cycle in the manual mode, the operator depresses pushbuttons on the control panel that bypass the PLC 95 outputs and operate relays to close valve 71 and open valve 69. The operator would end the cycle by manually closing valve 78.

The second level of control of the wellhead apparatus is also accomplished from control panel 24 under the control of the above-described PLC 95. In this local automatic mode, the operator switches to auto mode 100 and selects a pre-programmed cycle time on a 3-position selector switch 109 on the face of the control panel 24. Error checking is available in the automatic mode to ensure safe operation. The automatic mode cannot be initiated if the VFD 97 is in fault 110 (for instance, because of loss of power), sensor 49 senses that cable 36 is slack, or the swabbing tool 22 is not above the valve 78 as sensed by interaction between the above-described non-ferrous ring 28 mounted on swabbing tool 22 and non-ferrous proximity sensor/switch 80. An indicator light 111 on the face of control panel 24 indicates that the PLC 95 is in automatic mode. When the conditions for the automatic mode have been true for the pre-programmed cycle time selected by the 3-position selector switch on the face of the control panel 24, an internal timer 1 in the PLC 95 starts an automatic cycle.

The cycle is initiated automatically with the PLC 95 outputs opening valve 78 by actuator 79, closing valve 69 by actuator 73, and opening valve 71 by actuator 75. The PLC 95 monitors an end-of-travel switch 77 on valve 78 to determine whether valve 78 is in the fully open position. An internal timer 3 in the PLC 95 allows several seconds for the valves to operate. At the same time, the hydraulic pressure to oil saver 42 is released by PLC 95 output 112. Once internal timer 3 in the PLC 95 has expired and valve 78 is in the fully opened position, the PLC 95 energizes electric motor 46 through the VFD 97 interface 103 and electric motor 46 unwinds cable 36 from the winch/cable drum 38 to lower the swabbing tool 22. As cable 36 is lowering the swabbing tool 22, the PLC 95 monitors sensor 49 to determine whether the cable 36 is slack and also calculates a fault if the proximity switch/sensor 50 near the shaft of the winch/cable drum 38 indicates an excessive number of rotations of the drum of winch/cable drum 38 in a short amount of time. A fault condition stops the electric motor 46 and is indicated on the face of the control panel 24 as flashing indicator 113.

With no fault condition, the PLC 95 continues to lower the cable 36 by activating the lower 103 output to the VFD 97. An internal counter 2 in the PLC 95 utilizes proximity switch/sensor 50 to count rotations of the drum of winch/cable drum 38 to determine depth. The PLC 95 compares the accumulated total in the internal counter 2 in the PLC 95 to the value stored in the above-described calibration memory location and stops electric motor 46 when swabbing tool 22 reaches the predetermined depth. An internal timer 2 in PLC 95 allows the swabbing tool to dwell for a few seconds at the predetermined depth.

Once internal timer 2 in the PLC 95 has expired, the PLC 95 energizes electric motor 46 by activating the raise 106 output to the VFD 97 and reverses motor 46 to raise the swabbing tool 22 up out of the well. As cable 36 is raising the swabbing tool 22, the PLC 95 continues to monitor sensor 49 to determine whether the cable 36 is slack and to calculate a fault if the proximity switch/sensor 50 near the shaft of the winch/cable drum 38 indicates an excessive number of rotations of the drum of winch/cable drum 38 in a short amount of time. PLC 95 also monitors VFD 97 for a drive fault condition 110. A fault condition stops the electric motor 46 and is indicated on the face of the control panel 24 as flashing indicator 113.

With no fault condition, PLC 95 continues to raise the cable 36 until the swabbing tool 22 is above the valve 78 as sensed by interaction between the above-described non-ferrous ring 28 mounted on swabbing tool 22 and non-ferrous proximity sensor/switch 80. When the swabbing tool 22 is thus retrieved, the PLC 95 sounds a horn 107 in the control panel 24, opens valve 78 by actuator 79, closes valve 69 by actuator 73, and opens valve 71 by actuator 75. The internal timer 1 in the PLC 95 is also reset.

During the raising and lowering of the swabbing tool 22, the PLC 95 compares the accumulated total in the internal counter 2 in the PLC 95 to various calculated values. The calculated values in the PLC 95 can be expressed as percentages of or subtractions from the overall depth count stored in the calibration memory location. A comparison of the accumulated total in the internal counter 2 to these calculated values in the PLC 95 can be used to select PLC 95 outputs that are wired to alternative speeds (raise 106, lower 103, speed 1 120, and speed 2 125) on the VFD 97. The actual speeds of the raise, lower, speed 1, and speed 2 are programmed at the VFD keypad and display 98. In like manner, a comparison of the accumulated total in the internal counter 2 to a calculated value in the PLC 95 can be used to select a PLC 95 output 130 that pressurizes the oil saver 42 before the swabbing tool 22 is retrieved.

An alternative to a pre-programmed cycle time in the local automatic mode is the use of a pressure sensor 90 below valve 78 that starts a cycle when fluid is building in the well.

A third level of operation involves the interaction between the master control panel 26 and a plurality of control panels 24 operating the respective wellhead apparatus at the direction of a PLC 96 (not shown) located in master control panel 26. At the local control panel 24, the operator selects the auto mode 100 and selects the master control mode on a 3-position selector switch 109 on the face of the control panel 24. In this mode, the local control panel 24 will accept a start signal from master control panel 26 to begin a cycle. The local control panel 24, or slave, sends information to the master control panel 26, such as its fault condition, whether the local control panel 24 is in the automatic mode 111, whether master control is selected at the 3-position selector switch 109, and whether the slave has completed a cycle. These conditions are displayed at the master control panel 26 on an alphanumeric display (not shown). The master control mode is primarily used when the separator capacity for the field 10 will be exceeded if more than a few wells operate at a given time. The present invention utilizes an internal FIFO stack register in the PLC 96 at the master control panel 26 to sequence the wells.

The length of the internal stack register in the PLC 96 is greater than the number of wells in the field. Each well in the field is given a unique slave number or well address. A well is ready to run if the well is in auto mode 111, not in fault, on master control, and has completed a cycle. When these conditions for the well have been true for the pre-programmed time internal to the PLC 96 or the time selected by the operator at the alphanumeric display on the master control panel 26, the well address is put into the internal stack register in PLC 96. When the current well has finished its cycle, the contents of the internal stack register in PLC 96 are shifted down one step until a well is found that is ready to run.

The communication between the master control panel 26 and a plurality of control panels 24 is shown via radio transceivers in the preferred embodiment. A variety of other mediums are available to facilitate this communication, including communication bus cable, dedicated telephone lines, and cell phone modems.

These same communication media can be used to control and monitor the master control panel 26 from a remote location and to relay control signals to each of the control panels 24 for operation of the wellhead apparatus. For example, the master control panel can be assigned an internet address and be monitored from a remote location via a webpage. These same communication media can be used to monitor and control an individual control panel 24 from a remote location.

Those skilled in the art who have the benefit of this disclosure will recognize that certain changes can be made to the component parts of the apparatus of the present invention without changing the manner in which those parts function to achieve their intended result. All such changes, and others which will be clear to those skilled in the art from this description of the preferred embodiments of the invention, are intended to fall within the scope of the following, non-limiting claims.

What is claimed is:

1. Apparatus for producing fluid from a well comprising:

a riser attachable to the wellhead of a well;

a winch/cable drum having a cable wound thereon for winding and unwinding by rotating the winch/cable drum, the cable passing through said riser into the well and having a swabbing tool attached thereto;

first and second flowline connections in said riser, each of said flowline connections having a valve therein; and controls for rotating said winch/cable drum to retrieve the swabbing tool from the well and to open or close the valves in said flowline connections to allow the passage of oil, gas, or oil and gas raised from the well during retrieval of the swabbing tool.

2. The apparatus of claim 1 wherein said controls comprise a programmable logic controller programmed for switching a motor for rotating said winch/cable drum and controlling the direction of rotation and said valves.

3. The apparatus of claim 2 wherein said controls further comprise means for instructing said programmable logic controller from a remote location.

4. The apparatus of claim 2 additionally comprising means for counting rotations of said winch/cable drum and outputting a signal therefrom to said programmable logic controller.

5. The apparatus of claim 2 additionally comprising a sensor in said riser for detecting the swabbing tool when retrieved from the well and to output a signal to said programmable logic controller for stopping the rotation of said winch/cable drum.

6. The apparatus of claim 1 additionally comprising means for sealing against the cable for sealing the well.

7. The apparatus of claim 1 additionally comprising a derrick having a sheave mounted at the top thereof, the cable passing over the sheave from said winch/cable drum and downwardly therefrom to enter said riser.

8. The apparatus of claim 7 additionally comprising a tension bar, the cable passing under said tension bar before passing over the sheave, and means for outputting a signal to said controls for stopping rotation of said winch/cable drum upon movement of said tension bar resulting from slack in the cable.

9. The apparatus of claim 7 additionally comprising means for outputting a signal proportionate to the length of cable that passes over the sheave.

10. The apparatus of claim 1 wherein said riser is provided with a valve through which the swabbing tool passes for closing below the swabbing tool when the swabbing tool is retrieved from the well for sealing the well.

11. A method of producing fluids from a well comprising the steps of:

lowering a swabbing tool into a wellbore to a selected depth;

retrieving the swabbing tool from the wellbore to raise the fluids therein out of the wellbore;

opening a valve in a first flowline in fluid connection with the wellbore while retrieving the swabbing tool;

when the swabbing tool reaches a predetermined height, closing a valve under the swabbing tool; and opening a valve in a second flowline in fluid connection with the wellbore either while closing the valve under the swabbing tool or after closing the valve under the swabbing tool.

12. The method of claim 11 wherein the predetermined height of the swabbing tool is determined by detecting the presence of the swabbing tool.

13. The method of claim 11 wherein the presence of the swabbing tool is detected by a proximity sensor that outputs a signal to a programmable logic controller and the programmable logic controller is operative to close the valve under the swabbing tool.

14. The method of claim 13 wherein the programmable logic controller is also operative to open the valve in the second flowline.

15. The method of claim 11 wherein the swabbing tool is lowered into the wellbore under control of a programmable logic controller having an input thereto for detecting the rate at which the swabbing tool is being lowered.

16. The method of claim 15 wherein the programmable logic controller is operative to retrieve the swabbing tool in the event of a decrease in the rate at which the swabbing tool is being lowered.

17. An apparatus for producing fluids from a well comprising:

a riser attachable to the wellhead of a well;

a winch/cable drum having a cable wound thereon for winding and unwinding from said winch/cable drum by rotating the winch/cable drum, the cable passing through said riser into the well and having a swabbing tool attached to the end thereof;

a derrick having a sheave mounted at the top thereof, the cable passing over the sheave from said winch/cable drum and downwardly therefrom to enter said riser;

a tension bar, the cable passing under said tension bar before passing over the sheave, and means for stopping rotation of said winch/cable drum upon movement of said tension bar resulting from slack in the cable; and first and second flowline connections in said riser, each of said flowline connections having a valve therein.

* * * * *